US005960568A

United States Patent [19]

Bell et al.

[11] Patent Number: 5,960,568

[45] Date of Patent: Oct. 5, 1999

[54] SNAP-FIT CLEATS FOR FOOTWEAR

[75] Inventors: Michael Bell, 758 Rydal Green Dr., Rydal, Pa. 19046; Stanley W. Widmer, Browerville, Minn.

[73] Assignee: Michael Bell, Rydal, Pa.

[21] Appl. No.: 09/026,352

[22] Filed: Feb. 19, 1998

[51] Int. Cl.[6] ..... A43B 5/00; A43B 3/10

[52] U.S. Cl. ..... 36/134; 36/7.6

[58] Field of Search ..... 36/134, 62, 67 R, 36/67 D, 59 B, 59 R, 7.7, 7.6

[56] References Cited

U.S. PATENT DOCUMENTS

| | | | |
|---|---|---|---|
| 2,421,072 | 5/1947 | Kramer . | |
| 3,133,368 | 5/1964 | Phillips . | |
| 3,267,593 | 8/1966 | Turner . | |
| 3,566,489 | 3/1971 | Morley | 36/670 |
| 3,715,817 | 2/1973 | White et al. | 36/67 D |
| 3,738,026 | 6/1973 | Granger | 36/59 R |
| 4,306,360 | 12/1981 | Hagger | 36/59 R |
| 5,123,184 | 6/1992 | Ferreira | 36/134 |
| 5,321,901 | 6/1994 | Kelly | 36/134 |
| 5,361,518 | 11/1994 | Sussman et al. | 36/134 |
| 5,638,615 | 6/1997 | Korsen | 36/134 |
| 5,848,482 | 12/1998 | Bathum | 36/134 X |

*Primary Examiner*—B. Dayoan
*Attorney, Agent, or Firm*—Caesar, Rivise, Bernstein, Cohen & Pokotilow, Ltd.

[57] ABSTRACT

A cleat for use in a resilient flexible ground engaging portion of an article of footwear or an attachment for an article of footwear to provide resistance to slippage. The web of resilient material has an inner side and an outer side, and an aperture extending therethrough for receiving portions of the cleat assembly. The cleat assembly includes a base member, a projection member, and an optional cover member. The base member is an annular ring having a central opening and is arranged to be located within the opening in the web of resilient material. The projection member has a hub having an outer surface, from which a spike projects, and a flange projecting radially outward from the hub. The flange includes a peripheral bead. The projection member of the cleat assembly includes plural posts and the base member of that assembly includes plural lugs defining plural recesses therebetween. The hub includes plural longitudinally extending, spring fingers, each having an undercut free end which is arranged to be extended through the aperture in the web of resilient material and through the central opening in the base member to snap-connect to a respective portion of the base member. This action tightly holds portions of the web of resilient material contiguous with the aperture between the annular bead on flange and the base member and with the posts and the recess cooperating for intimately engaging the resilient material of the web to prevent displacement or loosening of the cleat assembly from the web of resilient material. The cap is arranged to be releasably snap connected to the projection member to cover the spike, when desired.

17 Claims, 5 Drawing Sheets

FIG. 1
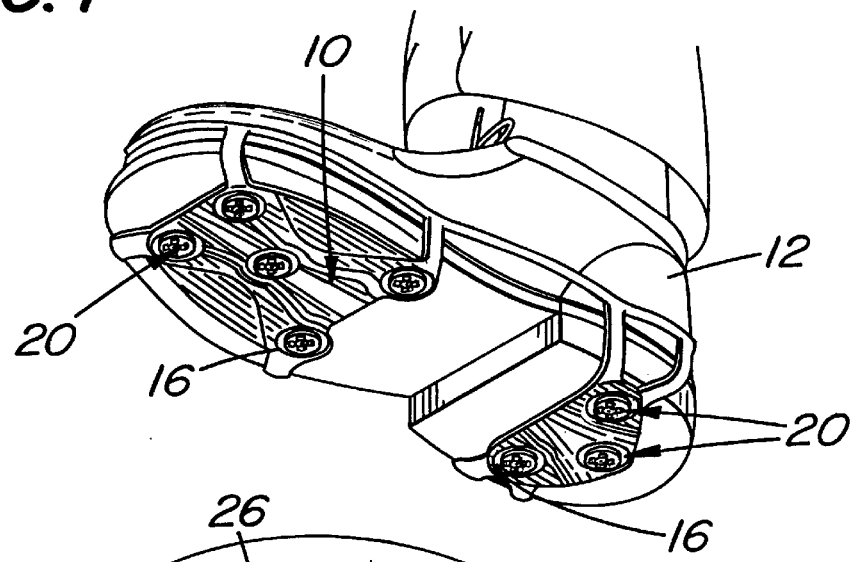
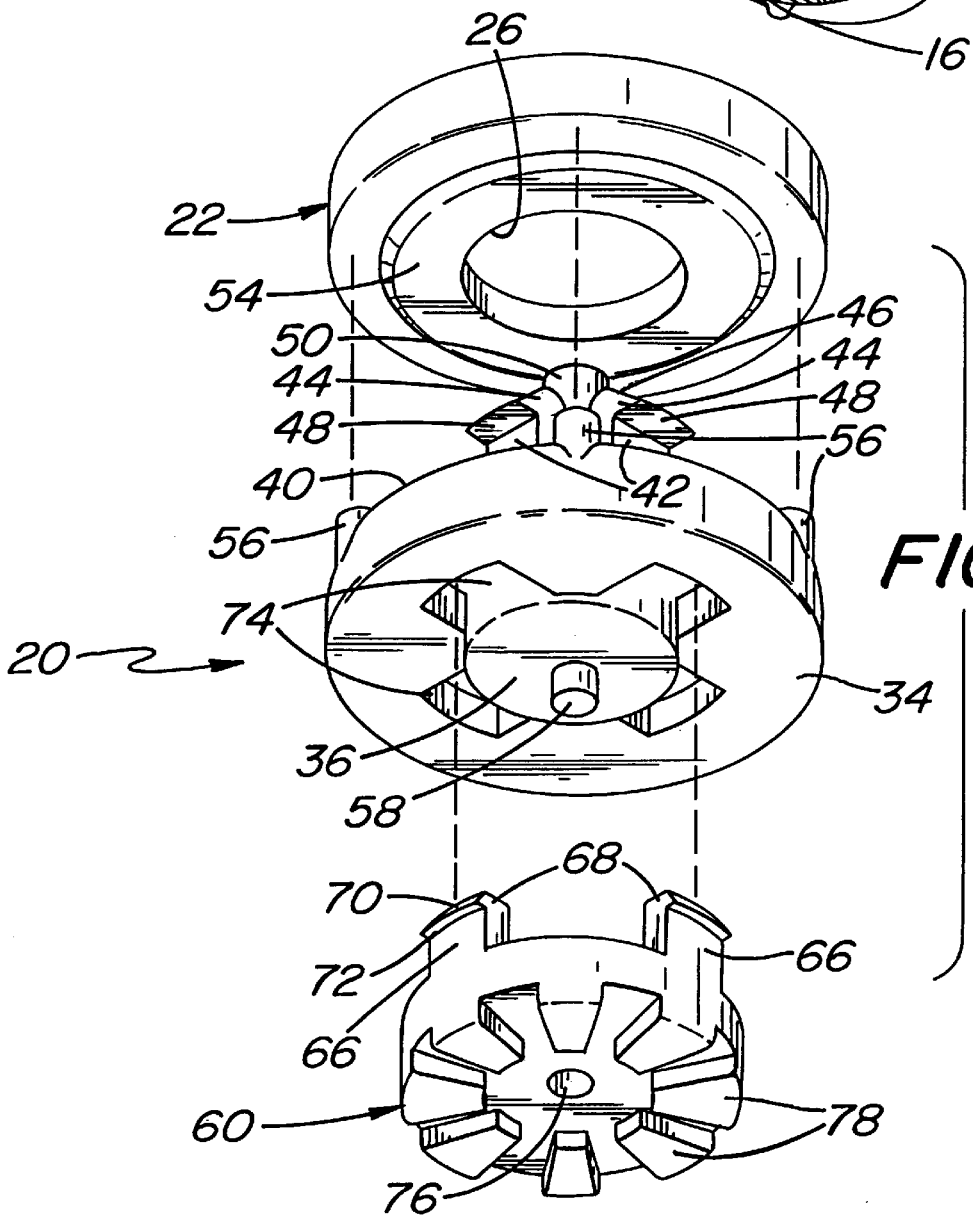
FIG. 3

SNAP-FIT CLEATS FOR FOOTWEAR

BACKGROUND OF THE INVENTION

This application relates generally to footwear and more particularly to cleats for permanent securement to stretchable and/or flexible ground engaging portions of footwear to provide increased resistance to slippage.

Some spike or cleat-bearing footwear attachments are commercially available for use on articles of footwear to prevent slippage on ice or other slippery surfaces. One such type of attachment is in the form of resilient rubber sling or overshoe having plural metal spikes or cleats on its bottom. The sling is arranged to be worn over an article of footwear, e.g., a boot or shoe. Owing to the stretchable nature of the rubber forming the sling or attachment, the cleats may become dislodged or loosened over time, thereby either ending its usefulness or otherwise detracting from its functionality.

The patent literature discloses various types of cleats or spikes for use on footwear for various purposes, e.g., enhanced traction on ice, grass, artificial sports surfaces, etc. Examples of prior art spikes/cleats are found in the following U.S. Letters Patent Nos.: 2,421,072 (Kramer), 3,133,363 (Phillips), 3,267,593 (Turner), 3,738,026 (Granger), 4,306,360 (Hagger), and 5321,901 (Kelly).

While the prior art footwear attachments/cleats may be generally suitable for their intended purposes, they still leave something to be desired from various standpoints, such as ease of assembly, resistance to dislodgement, convertibility, and effectiveness.

OBJECTS OF THE INVENTION

Accordingly, it is a general object of this invention to provide a cleat for use on a resilient or flexible ground engaging portion of an article of footwear or an attachment for an article of footwear which overcomes the disadvantages of the prior art.

It is another object of this invention to provide cleat which is easy to fixedly mount onto a sheet of resilient and/or flexible material.

It is another object of this invention to provide cleat for mounting onto a sheet of resilient and/or flexible material, and which when mounted is resistant to dislodgement therefrom.

It is another object of this invention to provide cleat which includes a hard penetrating projection rendering it particularly suited for providing resistance to slippage on ice.

It is another object of this invention to provide cleat which includes a penetrating projection for providing resistance to slippage on ice, but which can be readily converted by an optional cover to render the cleat useable on surfaces which could be damaged by the projection.

SUMMARY OF THE INVENTION

These and other objects of the subject invention are achieved by providing a cleat assembly for mounting onto a web of flexible resilient material, e.g., the sole of a non-slip footwear attachment or the sole of an article of primary footwear, to provide slip-resistance. The web of resilient material forming the footwear attachment or the footwear itself has an inner side and an outer side, and an aperture extending therethrough for receiving portions of the cleat assembly to mount the cleat assembly to the web.

The cleat assembly basically comprises a base member and a projection member. The base member is in an annular, e.g., plastic, ring having a central opening and is arranged to be disposed with respect to the web of material so that at least a portion of it is located within the aperture in the web of material. The projection member comprises a hub having an outer surface, a central longitudinal axis extending through the outer surface and a peripheral flange extending outward from the hub perpendicular to the central longitudinal axis. The hub includes a portion, e.g., plural flexible fingers each having an under-cut free end, arranged to be extended through the aperture in the web of material and through the opening in the base member for snap-connecting to a portion of the base member contiguous with that opening, to thereby tightly hold portions of the web of material contiguous with the aperture between the flange and the base member. The projection member includes a spike extending outward from the outer surface of the projection member. The spike is arranged to penetrate ice or other slippery surfaces, thereby increasing traction provided by the cleat, when the attachment is used on ice or other slippery surfaces.

In accordance with one aspect of this invention the projection member includes plural posts extending from the flange for intimate engagement with the resilient material of the web contiguous with the aperture to minimize the chances of accidental displacement or disconnection of the cleat assembly from that material.

In accordance with another aspect of this invention and to further minimize the chances of accidental displacement or disconnection of the cleat assembly from the web of resilient material, the base member includes plural lugs extending therefrom and defining therebetween plural recesses into which portion of the resilient material of the web are received. The posts extending from the gange of the projecting member extend into respective ones of these recesses for intimate eogagement with the resilient material therein.

In accordance with still another aspect of this invention the cleat assembly includes an optional cap member arranged to be releasably secured to the projection member of the cleat assembly to cover the spike, as desired.

DESCRIPTION OF THE DRAWING

Other objects and many attendant features of this invention will become readily appreciated as the same becomes better understood by reference to the following detailed description when considered in connection with the accompanying drawing wherein:

FIG. 1 is an isometric view of a non-slip, resilient material, footwear attachment shown in place on a conventional article of footwear, e.g., a boot, and with the attachment making use of plural cleat assemblies constructed in accordance with this invention;

FIG. 3 is an enlarged, exploded, isometric view of the embodiment of the cleat assembly of FIG. 2, but shown with an optional cover or cap constructed in accordance with this invention for releasable securement to that assembly;

DETAILED DESCRIPTION OF THE PREFERRED EMBODIMENTS

Figure 2:
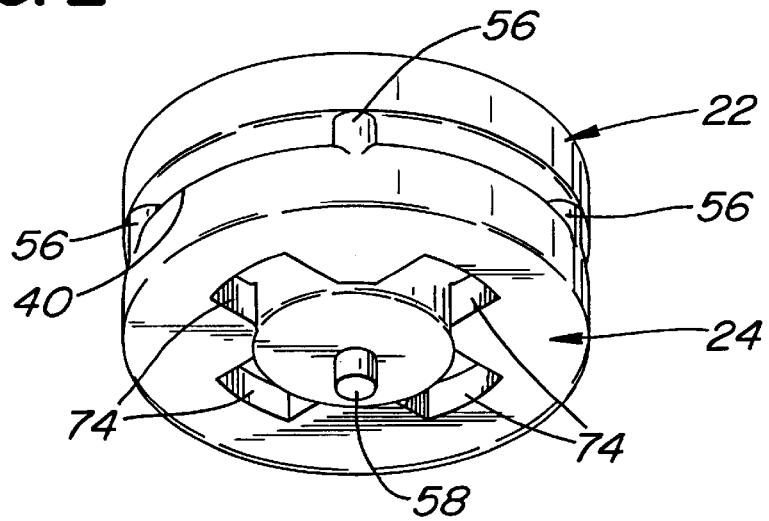
FIG. 2 is an enlarged isometric view of one embodiment of a cleat assembly of the subject invention shown in its assembled state.

Referring now to various figures of the drawing where like reference numerals refer to like parts there is shown in FIG. 1 a footwear attachment device 10 like that disclosed and claimed in copending U.S. patent application, Ser. No.: 09/012,108, filed on Jan. 22, 1998, entitled Traction Altering Attachment Device With Resilient Mounting Ring For Use On Footwear, which has been assigned to the same assignee as this invention and whose disclosure is incorporated by reference herein. That attachment device is arranged to be worn or mounted on any article of footwear, e.g., the boot 12 shown in FIG. 1, and includes plural slip-preventing cleat assemblies 20 constructed in accordance with this invention.

Figure 4:
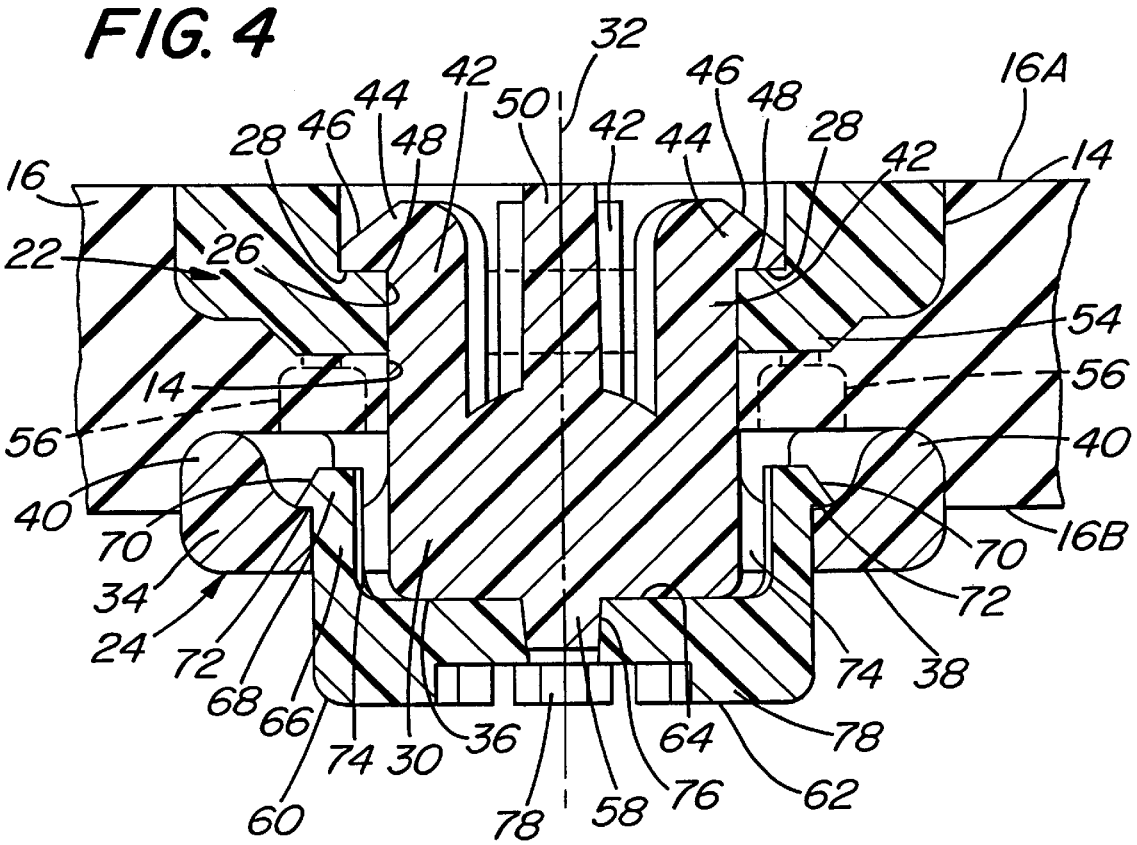
FIG. 4 is an enlarged sectional view taken through the central axis of an assembled cleat assembly having the optional cover releasably secured thereto.

As best seen in FIGS. 2–4 each cleat assembly 20 basically comprises a base member 22 and a projection member 24. As will be described in detail later the members 22 and 24 are arranged to be snap-connected to each other within an opening or aperture 14 (FIG. 4) in a web 16 of resilient material, e.g., rubber, making up a ground engaging portion of the attachment device 10. It must be noted that the web of resilient material 16 may itself constitute a portion of an article of footwear, e,g., the sole of a boot, or a portion of an article, e.g., an overshoe, worn over an article of footwear. Thus, the cleat assemblies of this invention can be used in any resilient or flexible material component to be worn on the foot of a person and which is arranged to engage the ground when the person walks. When so mounted, the cleat assemblies will minimize, if not eliminate, the chance of accidentally slipping on slippery surfaces, such as ice or snow.

In accordance with a preferred aspect of this invention each cleat assembly member 22 and 24 is preferably molded of any suitable hard and durable plastic material. As best seen in FIG. 4, the base member 22 is in the form of an annular ring or collar having a central opening 26 which is undercut to form a ledge 28. As mentioned above the base member is arranged to be disposed within the aperture 14 in the web of resilient material 16. In the embodiment shown herein that web of material makes up the ground engaging surface of the slip-preventing footwear attachment device 10. The base member 22 is located within the aperture 14 contiguous with the inner side 16A of the web 16.

The projection member 24 basically comprises a central hub 30 having a central longitudinal axis 32 and a peripheral flange 34 extending outward from the hub in a plane perpendicular to the axis 32. The outer surface 38 of the flange 34 is generally planar. The outer surface 36 of the hub 30 is also generally planar and extends slightly beyond the outer surface 38 of the flange 34. The under-surface of the flange 34 is in the form of an annular bead 40 extending about the periphery of the flange. The hub 30 also includes four elongated, spring fingers 42, extending parallel to one another and to the central longitudinal axis 32 in the opposite direction from the hub's outer surface 36. The fingers are equidistantly spaced from one another and each is located the same radial distance from the central longitudinal axis 32 so that their outer surfaces form respective arc-portions of a circle. Each finger terminates in a free end in the form of an ear 44 having an outer cam surface 46 and an under-cut inner surface 48. A post 50 is located along the central axis 32 and extends in the same direction as the fingers 42. The post serves to rigidify the projection member.

The fingers 42 are arranged to be extended through the aperture 14 in the web of resilient material 16 to secure the projection member 24 to the base member 22 and thereby assemble the cleat assembly 20. To that end the fingers 42 are extended through the aperture 14 in the web 16 from the outer side 16B of the web, and so that the cam surface 46 on their ears 44 ride over the material of the base member 24 contiguous with the central opening 26 therein, whereupon the free ends of the fingers flex radially inward slightly so that the free ends of the fingers can extend fully through the central opening 26 in the base member. When the ears of the fingers have cleared the edge of the ledge 28 of the base member, the fingers snap back, i.e., move radially outward, whereupon the under-cut surface 48 of each finger intimately engages a respective portion of the ledge 28. The length of the fingers is selected so that when the projecting member 24 and the base member 22 are connected together, as just described, the resilient material of the web 16 contiguous with the aperture 14 is tightly squeezed or compressed between the annular bead 40 on the underside of the flange 34 and the slightly raised annular top surface 54 and the remainder of the top surface ofthe base member 22. This action assembles the cleat assembly 20 and effectively locks it in place against accidental disconnection or displacement.

To further assure that the cleat assembly is resistant to dislocation from the aperture 14 in which it is mounted, the projection member 22 includes a plurality of small posts or locator pins 56 extending outward from the annular bead 40 at equidistantly spaced locations along the periphery thereof. The pins 56 are of a sufficient height that they dig into the resilient material of the web 16 which is compressed between the flange 34 and the base member 22, thereby preventing displacement, e.g., twisting, or disconnection, of the cleat assembly.

In order to enhance the traction provided by the attachment 10 (or any other article utilizing at cleat assembly constructed in accordance with this invention), the projection member of each cleat assembly preferably includes a spike 58 projecting outward slightly, e.g., ⅛th inch (3.2 mm), beyond the outer surface 36 of the projection member. The spike is centered on the central longitudinal axis, and is preferably molded integrally with the projection member. Alternatively, the spike 58 can be formed of any suitable hard material, e.g., metal, and can be inserted within a bore in the hub and locked in place by some means either mechanical or adhesive (not shown) or may be molded in situ in the projection member. In any case the projecting spike will serve to penetrate ice, thereby increasing traction provided by the cleat assembly when used on icy surfaces.

If it is desired to protect the surface, such as the floor of a building, on which the attachment device 10 will be used from being penetrated or otherwise damaged by the projecting spike 58 of each cleat assembly, an optional cap or cover 60 can be used with each assembled cleat to cover the spike. As best seen in FIGS. 3 and 4 each cover 60 basically comprises is a circular disk-like member having an outer surface 62 and an inner surface 64. A plurality of elongated spring fingers 66 project about the periphery of the disk like member from its inner surface 64. The spring fingers 66 are each constructed similarly to the spring fingers 44 and are disposed at equidistantly spaced locations around the periphery of the cover. Each finger terminates at its free end in an ear 68 having a cam outer surface 70 and an undercut inner surface 72. Each finer 66 is arranged to be extended through a corresponding slot 74 in the projection member 24 to releasably secure the cover 60 thereto. The cover 60 also includes a central bore 76 for receipt of the spike 58 when the cover is secured to the projection member of the assembled cleat assembly.

The cover 60 is releasably secured to the assembled cleat assembly by extending its fingers 66 through the respective slots 74 in the projection member to cause the fingers to flex slightly inward in the same manner as described with reference the fingers 42. Thus, when the undercut portion 72 of each ear 68 of each of the fingers 66 has cleared the inner surface of the flange 34, the fingers are able to snap back, thereby locking the cover 30 in place. The amount of undercut of the ears 68 is selected to be large enough to securely hold the cover in place against accidental disconnection, but sufficiently small to enable the cover to be manually pulled off of the cleat to which it is attached when its use is no longer desired. When the cover 60 is in place on the projection member 24 the cover's undersurface 64 engages the outer surface 36 of the hub of that member and the spike 58 is received within the bore 76.

While the cover 60 is designed to cover the cleat to protect somewhat delicate floor surfaces on which the cleat may be used, the cover can itself provide a traction-altering function. Thus, the outer surface 62 of the cover 60 can have any type of surface feature desired to provide a desired amount of traction. For example, in the embodiment 60 shown herein that surface includes plural small radially extending cleats 78 to provide increased traction over slippery surfaces, without damaging indoor flooring or other delicate surfaces. Alternatively, the cover may include some different material to enhance traction, e.g., some hard particulate grit may be provided on the outer surface. In fact, the entire cover or only its outer surface may be constructed to decrease traction. For example, the cover can be formed of a slippery material such as polytetrafluroethylene (TEFLON®). This arrangement may be desirable for some applications where a footwear attachment device having cleats to prevent slipping may be desired to be converted for use indoors in applications requiring decreased traction, e.g., aerobic exercise simulating skating or bowling.

In FIGS. 5–8 there is shown another embodiment of a cleat assembly constructed in accordance with this invention. The assembly is designated by the reference number 100 and is particularly suited for mounting in any web of material which stretches very easily, e.g., highly resilient and/or very thin resilient material, to prevent accidental disconnection or displacement of the cleat assembly as the web flexes or stretches during walking or other activity. The cleat assembly 100 is identical to the cleat assembly 20, except for the construction of its base member. Thus, the cleat assembly 100 includes an alternative base member 102, the previously described projection member 24, and the optional cover 60. The alternative base member 102 is identical in construction to the base member 22, except for the inclusion of plural lugs and recesses (to be described later) therein. In the interests of brevity the common components of the cleat assembly 100 and the cleat assembly 20 will be given the same reference numbers and their construction, function and operation will not be reiterated.

Figure 5:
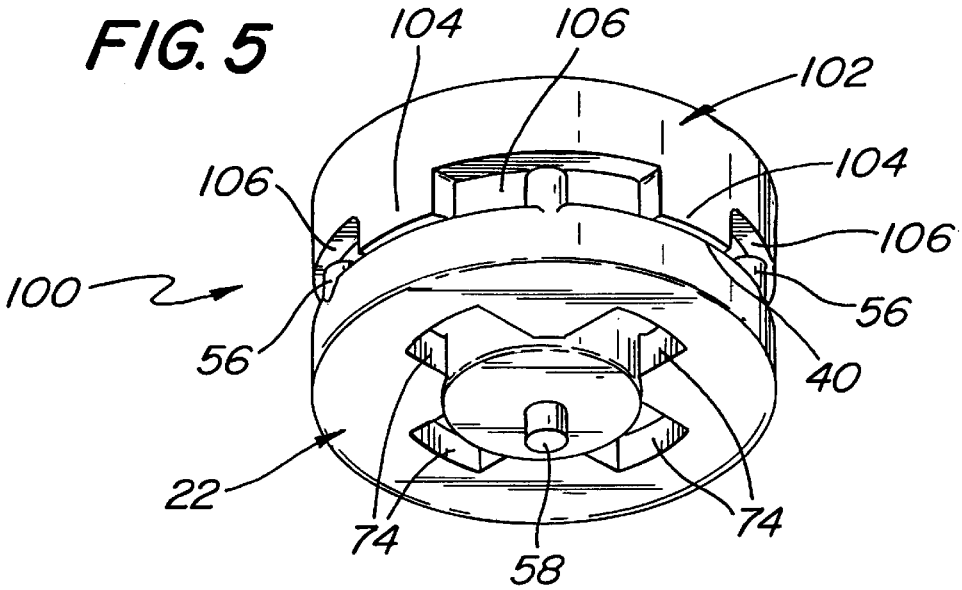
FIG. 5 is an isometric view, similar to FIG. 2, but showing another embodiment of a cleat assembly of the subject invention without the optional cover or cap mounted thereon.
Figure 7:
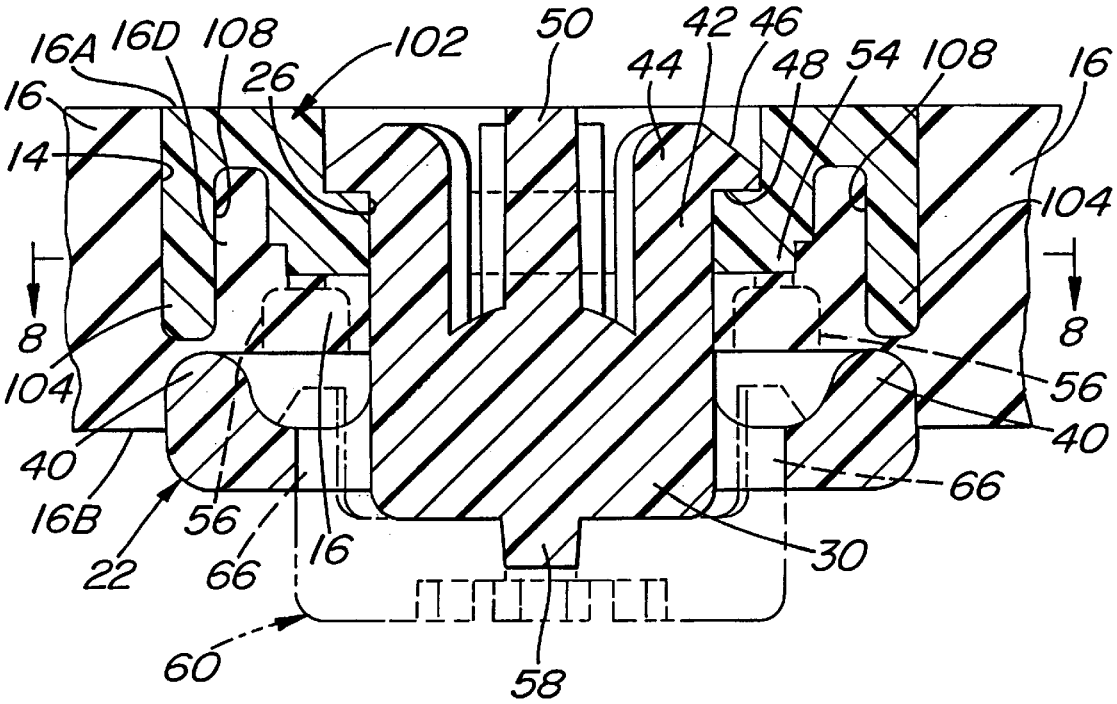
FIG. 7 is an enlarged sectional view similar to FIG. 4 but showing an assembled cleat assembly of the embodiment of FIGS. 5 and 6 with the optional cap shown in phantom lines.
Figure 6:
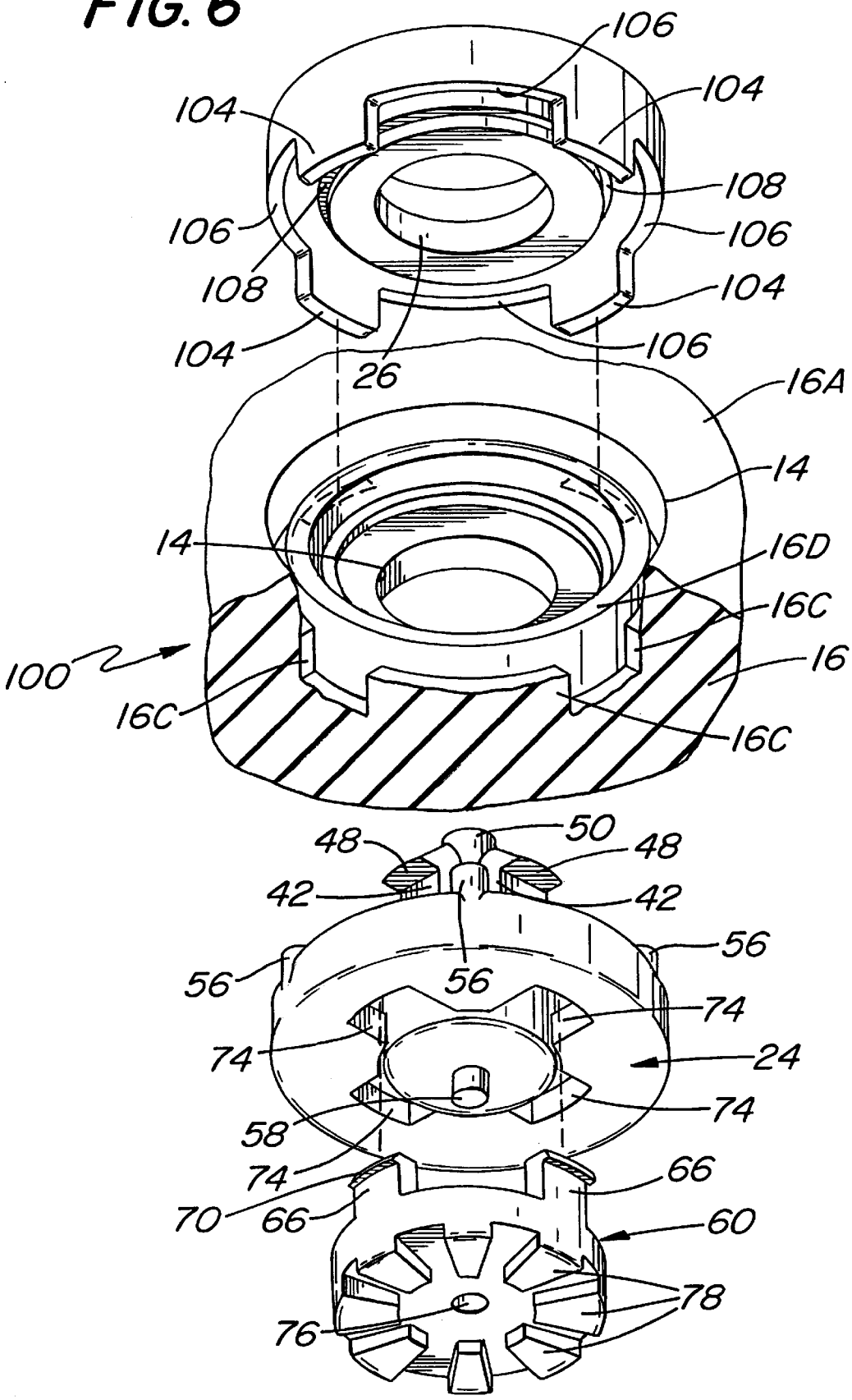
FIG. 6 is an enlarged, exploded, isometric view of the embodiment of the cleat assembly of FIG. 5 with the optional cover or cap, and showing a portion of the resilient material web of the non-slip footwear attachment to which the cleat assemblies are secured.
Figure 8:
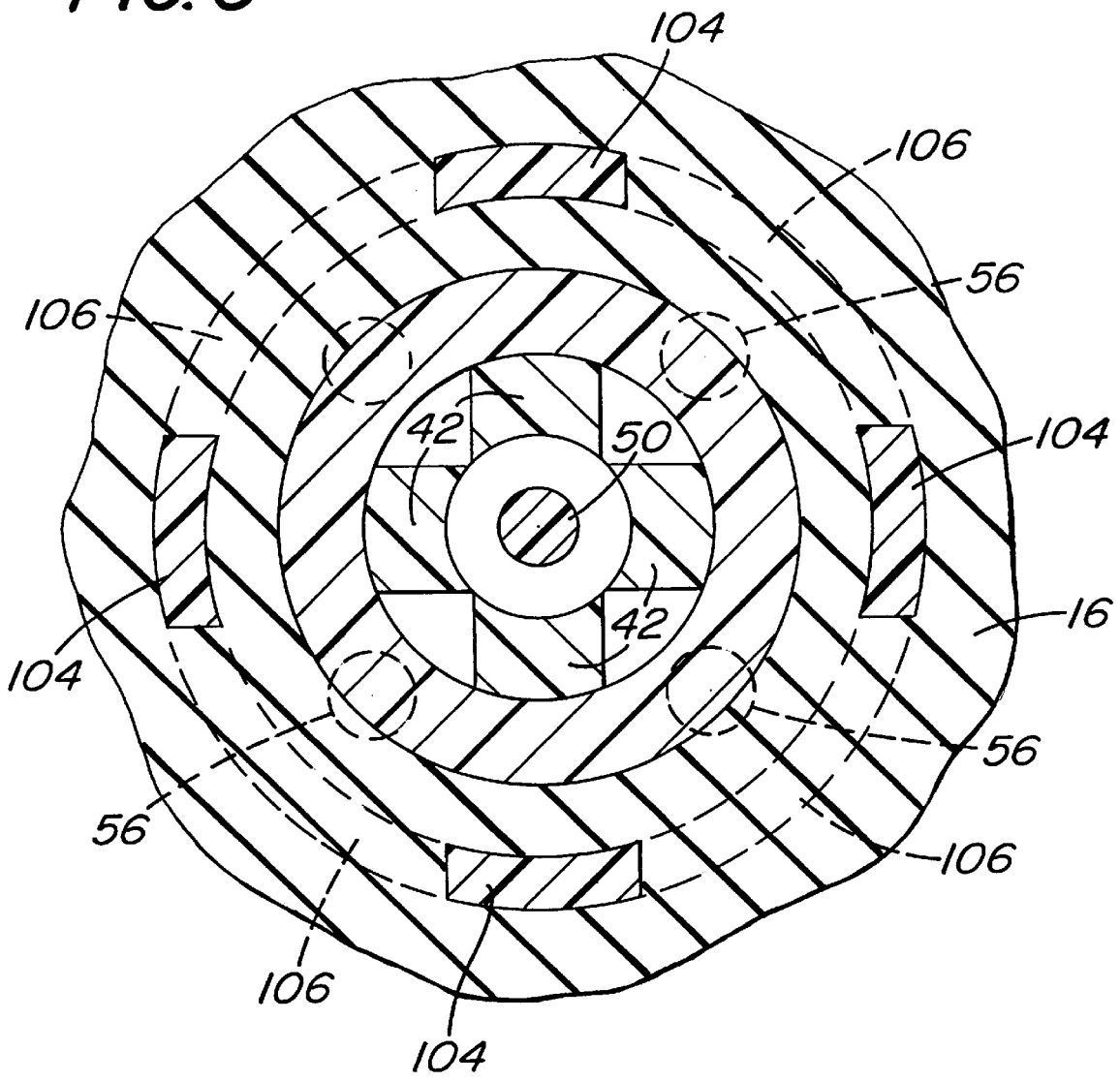
FIG. 8 is a sectional view taken along line 8—8 of FIG. 7.

As can be seen in FIGS. 5 and 6 the base member 102 includes a plurality of lugs 104 projecting downward from its outer surface at equidistantly spaced locations about the periphery of base member. This arrangement creates a plurality of recesses 106 located between the lugs 104. These recesses are sized and spaced at appropriate distances from one another to receive the projecting pins 56 of the projection member 24 when the cleat assembly 100 is assembled, i.e., the member 24, is secured to the base member 102. An annular recess 108 is also provided in the outer surface of the base member 102, just within the inner surface of the lugs 104.

The lugs 104 and recesses 106 and 108 cooperate with the annular bead 40 and the projecting locator pins 56 of the projection member 24 to securely lock the assembly in place against accidental removal or displacement, even when the assembly is mounted in a highly stretchable web. In particular, as will be appreciated by those skilled in the art, and as shown in FIG. 6 when the projection member 24 is secured to the base member 102, portions 16C of the resilient material of the web 16 adjacent the aperture 14 will be squeezed into the recesses 106 between the lugs 104 and other portions 16D of that web of material will be squeezed into the annular recess 108 in the outer surface of the base member. At the same time the pins 56 of the projection member 24 will dig into the resilient material portions 16C located within the recesses 106, thereby further locking the cleat assembly 100 to the highly resilient material forming the web. If desired, the material making up the web 16 may be preformed to include plural small apertures or bores (not shown) located at equidistantly spaced locations about the periphery of the cleat-assembly-receiving aperture 14 to accommodate the locator pins 56 of the projection member 24 when the projection member and the base member 22 or 102 are secured together. In addition, or alternatively, the aperture 14 in the web of material 16 may be shaped or contoured to accommodate the base member 22 or 102 therein without any stretching of the material of the web 16, instead of being a simple constant diameter hole.

As should be appreciated by those skilled in the art from the foregoing the cleat assemblies of this invention are constructed to render them resistant to displacement when mounted in a resilient material, with the embodiment of FIGS. 5–8 being particularly resistant to displacement in very elastic or stretchable materials. However, the cleat assemblies of the invention may also be used in other applications as well, e.g., in less stretchable materials of footwear or attachments for footwear. Thus, the cleat assemblies of this invention are simple in construction, low in cost, easy to assemble devices suitable for use in a great many applications.

Without further elaboration the foregoing will so fully illustrate our invention that others may, by applying current or future knowledge, adopt the same for use under various conditions of service.

What is claimed is:

1. A cleat for mounting to a resilient flexible ground engaging portion of an article of footwear or an attachment for an article of footwear to provide resistance to slippage, the web of resilient material having an inner side and an outer side, and an aperture extending therethrough for receiving portions of said cleat assembly, said cleat assembly comprising a base member and a projection member, said base member being an annular ring having a central opening therein and being arranged to be disposed on the web of material so that at least a portion of said base member is located within the aperture in the web of material, said projection member comprising a hub having a central longitudinal axis and a peripheral flange extending outward from said hub, said hub including a portion arranged to be extended through the aperture in the web of material and through said central opening in said base member for non-threadedly snap-connecting to portions of said base member contiguous with said central opening, whereupon portions of the web of material contiguous with the aperture are tightly held between said flange and said base member.

2. The cleat assembly of claim 1 wherein said projection member comprises a outer surface and a spike extending outward from said outer surface.

3. The cleat assembly of claim 1 wherein said hub comprises at least one extending finger having a free end arranged to engage a surface portion of said base member contiguous with said central opening in said base member.

4. The cleat assembly of claim 3 wherein said free end of said at least one finger includes an undercut portion arranged to snap-connect to said surface portion of said base member contiguous with said central opening in said base member.

5. The cleat assembly of claim 1 additionally comprising plural posts projecting from said flange for intimate engagement with the web of resilient material of the attachment device when said cleat assembly is secured thereto.

6. The cleat assembly of claim 1 wherein said flange includes an annular bead extending about the periphery thereof for intimate engagement with the web of resilient material of the attachment device when said cleat assembly is secured thereto.

7. The cleat assembly of claim 6 additionally comprising plural posts projecting from said annular bead of said flange for intimate engagement with the web of resilient material of the attachment device when said cleat assembly is secured thereto.

8. The cleat assembly of claim 1 wherein said base member includes plural lugs projecting therefrom to define plural recesses therebetween into which portions of the web of resilient material of the attachment device is located when said cleat assembly is secured thereto.

9. The cleat assembly of claim 8 additionally comprising plural posts projecting from said flange, each of said posts being arranged for intimate engagement with a respective portion of the web of resilient material of the attachment device located within said recesses of said base member when said cleat assembly is secured thereto.

10. The cleat assembly of claim 8 wherein said flange includes an annular bead extending about the periphery thereof for intimate engagement with the web of resilient material of the attachment device when said cleat assembly is secured thereto.

11. The cleat assembly of claim 10 additionally comprising plural posts projecting from said annular bead, each of said posts being arranged for intimate engagement with a respective portion of the web of resilient material of the attachment device located within said recesses of said base member when said cleat assembly is secured thereto.

12. The cleat assembly of claim 1 additionally comprising a cover member arranged to be releasably mounted on said projection member.

13. The cleat assembly of claim 12 wherein said cover member includes at least one finger extending therefrom, and wherein said projection member includes at least one aperture therein for receipt of said at least one finger of said cover member to releasably secure said cover member to said projection member.

14. The cleat assembly of claim 13 wherein said cover member comprises plural fingers extending therefrom, each of said fingers having an undercut free end, and wherein said projection member comprises plural apertures extending through said flange about the periphery of said hub for receipt of respective ones of said plural fingers to releasably secure said cover member to said projection member.

15. The cleat assembly of claim 1 wherein said base member and said projection member are each formed of a plastic material.

16. The cleat assembly of claim 12 wherein said cover member is formed of a plastic material.

17. The cleat assembly of claim 15 and wherein said cover member is formed of a plastic material.

* * * * *